United States Patent [19]

Bloemendal et al.

[11] Patent Number: 4,928,926

[45] Date of Patent: May 29, 1990

[54] FLUID PRESSURE OPERATED PUSH BEAM AND APPARATUS COMPRISING ONE OR MORE OF SUCH PUSH BEAMS

[75] Inventors: Berend J. Bloemendal, Emmen; Marinus J. G. Bromhaar, Hengelo, both of Netherlands

[73] Assignee: Persluchtring Advies B.V., Emmen, Netherlands

[21] Appl. No.: 154,551

[22] Filed: Feb. 10, 1988

[30] Foreign Application Priority Data

Feb. 10, 1987 [NL] Netherlands ..... 8700307

[51] Int. Cl.[5] ..... B66F 3/24

[52] U.S. Cl. ..... 254/93 R; 5/81 R; 414/495; 414/480; 901/37

[58] Field of Search ..... 5/11, 81 R, 63; 254/93 HP, 2 R; 414/495, 480; 901/27, 37; 108/144; 294/99, 88, 98.1, 86.15

[56] References Cited

U.S. PATENT DOCUMENTS

| | | | |
|---|---|---|---|
| 3,202,061 | 8/1965 | Johnson | 294/88 |
| 3,261,617 | 7/1966 | Becker et al. | 254/2 R |
| 3,284,964 | 11/1966 | Saito | 52/2 |
| 3,343,864 | 9/1967 | Baer | 901/37 X |
| 3,379,411 | 4/1968 | Vanderjagt | 254/93 |
| 3,420,331 | 1/1969 | Minnite | 182/41 |
| 3,730,366 | 5/1973 | Berends | 414/495 |
| 3,981,528 | 9/1976 | Andorf et al. | 901/37 X |
| 4,350,381 | 9/1982 | Hellmann | 901/37 X |
| 4,614,084 | 9/1986 | Clot et al. | 60/325 |

FOREIGN PATENT DOCUMENTS

| | | | |
|---|---|---|---|
| 0017016 | 10/1980 | European Pat. Off. . | |
| 0113145 | 7/1984 | European Pat. Off. . | |
| 0165635 | 12/1985 | European Pat. Off. . | |
| 854100 | 3/1943 | Fed. Rep. of Germany . | |
| 2345856 | 3/1975 | Fed. Rep. of Germany . | |
| 1500113 | 9/1967 | France . | |
| 1055463 | 1/1967 | United Kingdom . | |
| 1159362 | 7/1969 | United Kingdom | 294/98.1 |

*Primary Examiner*—Gary L. Smith
*Assistant Examiner*—Michael Milano
*Attorney, Agent, or Firm*—Gottlieb, Rackman & Reisman

[57] ABSTRACT

A fluid pressure operated push beam is disclosed which comprises a plurality of similar rigid open-ended tube sections (1) articulated in head-to-tail relationship around hinge pins (3) perpendicular to a longitudinal median plane of the push beam (10). A number of plates (2) corresponding to the number of hinge pins (3) are connected for tilting movement to respective ones of the hinge pins (3), with the plate portions situated on opposite sides of the hinge pins (3) being disposed in the tubular sections (1) located on the corresponding sides, and the plates having a width smaller than the width of the tubular sections (1).

An inflatable hose, such as an inner-arc hose (4), which may be segmented and which has a length shorter than the total length of the series of tubular sections but exceeding the distance between the outer or outermost hinge pins, is provided within the series of tubular sections to extend in longitudinal direction in the space on the same side of the hinge pins (3). The hose has closable supply means for a pressure fluid operative for inflating the hose.

13 Claims, 2 Drawing Sheets

Figures 1, 2:
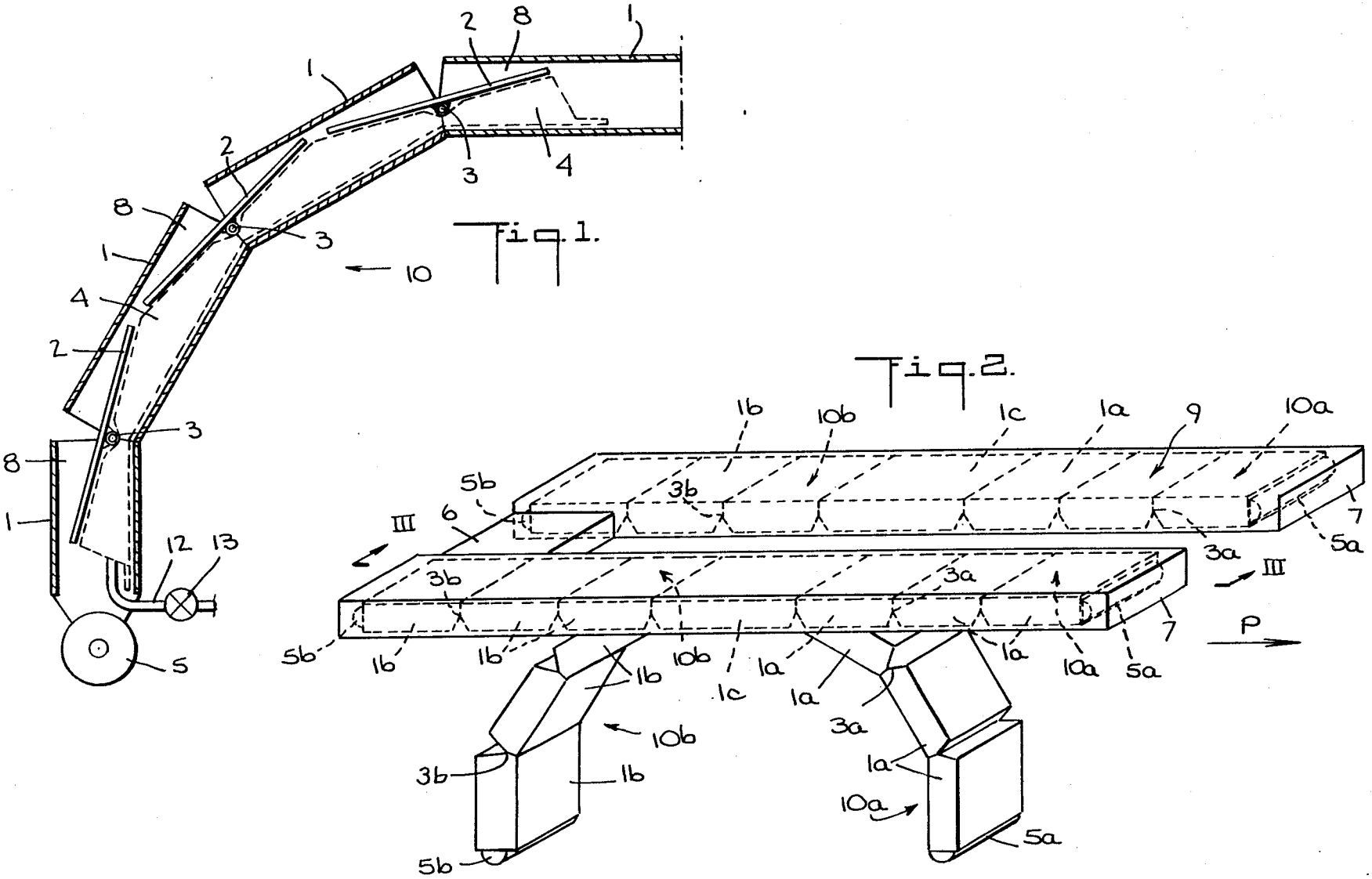
Figure 1:
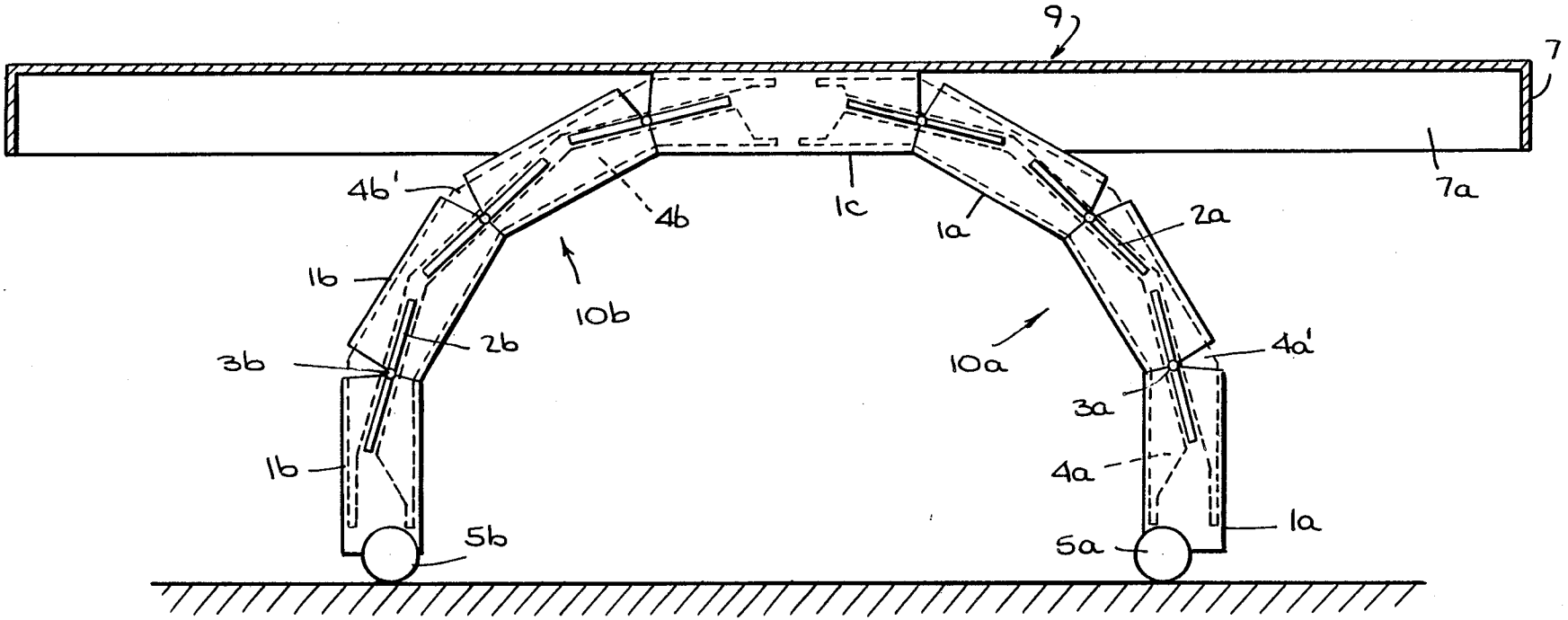

10
P
III
1
1a
1b
1c
2
3
3a
3b
4
5
5a
5b
6
7
8
9
10a
10b
12
13

FLUID PRESSURE OPERATED PUSH BEAM AND APPARATUS COMPRISING ONE OR MORE OF SUCH PUSH BEAMS

This invention relates to a fluid pressure operated push beam.

It is an object of the present invention to provide an improved pressure operated push beam of novel construction, wherein the pushing movement is not the exclusive result of a truly rectilinear displacement of the components of the push beam. It is a further object of the invention to provide a fluid operated push beam which is of simple construction and operation.

The present invention is characterized by a plurality of similar rigid open-ended tubular sections articulated in head-to-tail relationship around hinge pins perpendicular to a longitudinal median plane of the push beam;

a number of plates corresponding to the number of hinge pins, each plate being connected intermediate its ends to a respective one of the hinge pins for tilting movement about the axis of that hinge pin, and the plate portions situated on the opposite sides of the hinge pins being disposed in the tubular sections located at the corresponding sides, and the plates having a width smaller than the width of the tubular sections; as well as an inflatable inner arc hose or interconnected inner arc hose segments forming a hose, said hose having a length which is less than that of the series of sections but larger than the distance between the outermost hinge pins, the hose being provided within the series of tubular sections so as to extend the tubular sections into linear alignment in the longitudinal direction in the space on the same side of the hinge pins and further having closable supply means for a pressure fluid operative for inflating the hose.

The operation of the push beam according to the present invention is controlled by the operation of the hose or hoses associated with the push beam. Each hose of a push beam according to the present invention can be inflated and deflated, which primarily will result in a change of diameter of the hose. The inflation or deflection is effected by supplying to, or discharging from, the hose a pressure fluid, e.g. a gas, such as air, or a liquid, such as water. Explained, for the sake of simplicity, on the basis of an air-operated hose, the operation of a push beam according to the present invention can in general be described as follows. When a hose is inflated, it will tend to expand on all sides. This increase in volume, however, is impeded adjacent the hinge pins, so that the hose is constricted at each such location relative to those portions of the hose located in the areas between the hinge pins, where the transverse expansion of the hose can develop much further. Due to the unequal transverse expansion, the hose gets an irregular contour as viewed in longitudinal direction. In the areas between the hinge pins, the expanding hose will press forcibly on one side against the plates which are pivotable about the hinge pins, and on the other side against the inner walls of the tubular sections. Each plate, by virtue of being able to pivot about a respective hinge pin, will eventually occupy a position of equilibrium determined by the forces acting on that plate on both sides of the hinge pin. In its totality, the push beam will be curved to a rigid arc by the forces exerted by the inflated hose, with the inner arc being formed on the side of the hose abutting against the inner wall of the tubular sections of the push beam.

Within the series of tubular sections a second inflatable hose, i.e., an outer arc hose, may be provided on the other side of the hinge pins. By regulating the compressed-gas control for the two hoses in mutually dependent relationship, e.g. via a per se known five-way valve, the two hoses can be controlled in such a manner that e.g. a push beam bent into an arcuate shape is stretched again by inflating the hose present on the side of the outer arc of the push beam, or the outer arc hose, with concomitant deflation of the hose present on the inner arc side, i.e. the inner arc hose. By a combined control of the inner arc hoses and the outer arc hoses, it is also easier to accomplish fine adjustment of the working position of the push beam, so that, all in all, an embodiment of the push beam according to the present invention comprising two hoses is preferred.

The present invention also relates to an apparatus comprising at least one push beam and preferably a plurality of push beams according to the present invention by means of which, for example, a loading platform can be supported, with the resulting apparatus being useful as an aid in loading and unloading.

The present invention will now be described, by way of example, with reference to the accompanying drawings, in which:

FIG. 1 is a diagrammatic, longitudinal section of a push beam in operating position, the push beam having a single inflatable hose;

FIG. 2 is a schematic illustration, in perspective, of the side view of an apparatus comprising a pallet loading platform supported by four push beams, of which two are shown in solid lines as erected in operating position and in broken lines as extended into the loading platform and the other two are shown only in broken lines as extended into the loading platform, which apparatus is usable especially as an aid in loading and unloading a so-called 3-door or 5-door station wagon; and FIG. 3 is a cross section on the line III—III of FIG. 2.

The same reference numerals in FIGS. 1–3 of the drawings relates to members having analogous functions.

FIG. 1 shows at 10 a push beam in a position wherein an inner arc hose 4 is inflated with a gas, the admission and release of the gas being selectively effected through a conduit 12 controlled by a suitable multi-way valve 13.

The push beam 10 is composed of a plurality of sections 1, each having the form of a flat tube of rectangular cross section, made from construction metal having the strength to resist the forces to which the push beam will be subjected when in service.

Sections 1 are articulated and pivotally connected to each other by means of respective hinge pins 3. The hinge pins are situated a short distance below the longitudinal center lines of the tubular sections between the outer and inner arcs formed by the upper and lower interior wall surfaces of the tubular sections of the push beam 10.

FIG. 1 shows a plurality of sheet iron plates 2 pivotable about the hinge pins 3. In the portions of the spaces 8 within the hollow push beam sections 1 below the plates 2, a dotted line indicates the contours of the inflated inner arc hose 4.

In the portions of the spaces 8 of the tubular sections 1 on the other side of hinge pins 3, i.e., above the plates 2, a second inflatable hose (not shown in FIG. 1) constituting an outer arc hose may be provided, analogously to the inner arc hose 4, and which can also be inflated with a compressed gas, such as compressed air. The compressed air control of the separate hoses can be interconnected, with advantage, e.g. via conventional five-way valve, for purposes to be explained hereinafter.

In the erected position of the push beam, it can be moved over the ground, e.g. a floor, on which it is installed, by means of one or more wheels or rolls 5 provided on the bottom end of the push beam. The tubular section 1 at the opposite or top end of the basic push beam construction 10 shown in FIG. 1 can be used to interconnect the push beam with another push beam identical to and in mirror image relation with the push beam 10, as will be explained hereinafter in connection with the description of the structure shown in FIGS. 2 and 3.

In the apparatus shown in FIGS. 2 and 3, which is suitable in particular as an aid in loading and unloading a station wagon, two such push beams, which are designated 10*a* and 10*b* and each of which corresponds to the push beam 10 shown in FIG. 1, each being composed of a respective set of tubular sections 1*a* or 1*b* articulated to each other by hinge pins 3*a* or 3*b*, each being paired with the other at the top end by a mutual connecting section 1*c* and having a roller or wheel 5*a* or 5*b* at its bottom end, and each having arranged therein a respective set of pivoted plates 2*a* or 2*b* and respective inner and outer arc hoses 4*a*, 4*a*′ or 4*b*, 4*b*′, are mounted underneath each of the two illustrated loading beams 7. For the sake of convenience and simplicity, only the push beams 10*a* and 10*b* associated with the front loading beam 7 (as viewed in FIG. 2) are shown in both their solid-line erected and operating position and their broken-line extended position; the push beams of the rear loading beams are shown only in their broken-line extended position. The loading beams 7 are constructed as straight inverted channel-shaped or U-shaped members in the downwardly open channels 7*a* of which are slidably disposed the connecting tubular sections 1*c*. The loading beams thus constitute guides for the push beams. The beams 7 are interconnected by means of a bridge beam 6 to form a rigid construction or loading platform 9.

The apparatus shown in FIG. 3 is in the operating position, in which the outer arc hoses 4*a*′ and 4*b*′ are deflated while the inner arc hoses 4*a* and 4*b*, abutting against the inner arc of the push beams 10*a* and 10*b*, are inflated with compressed air. When the push beams 10*a* and 10*b* are in the rest position, i.e. when the inner arc hoses of the push beams have been deflated and the outer arc hoses inflated, the push beams are in a stretched or extended position and are received within the channels of the loading beams, as shown in broken lines in FIG. 2.

A substantial part of road transport of goods takes place in station wagons or in vans. Due to the presence of an upwardly hinging tail board as a third or fifth door, mechanical loading or unloading of such wagons or vans by means of a fork lift truck is often very difficult or even not possible. For such a truck has a vertical upright member and, as a result, cannot approach the station wagon as closely as is desirable, because the rear door of the latter is hinged upwards. A so-called hand pallet truck, it is true, lacks an upright, but cannot sufficiently lift the load, so that in actual practice, station wagons are loaded and unloaded manually. Naturally, this creates a problem in the case of heavy loads, so that often more persons are needed to perform the work than are available or economical. The loading of the station wagon can take place in a simple manner, however, when use is made of an apparatus according to the present invention, as shown in FIG. 2, in the following manner.

The load to be transported is placed on the loading platform 9, which is lifted to the appropriate level by inflating the inner arc hoses 4*a* and 4*b* while the outer arc hoses 4*a*′ and 4*b*′ are deflated (FIG. 3). If placed on a pallet, the load can be easily delivered by a fork lift truck and placed, together with the pallet, on the loading platform 9. Subsequently, the loading apparatus, rolling on the wheels 5*a* and 5*b*, is pushed in the direction of the station wagon (arrow P). By means of compressed air, and by selective adjustment of the air pressure in the outer-arc hoses 4*a*′ and 4*b*′ and the inner-arc hoses 4*a* and 4*b*, the loading platform 9 is raised to a level slightly above the floor level of the station wagon, and the loading platform is then pushed further while the push beams remain stationary, so that the loading beams slide over the connecting tubular sections 1*c* of the push beams until the leading ends of the loading beams 7 (the right-hand ends in FIGS. 2 and 3) overhang the floor of the station wagon. The inner arc hoses 4 of the push beams 10*a* are then deflated slightly, until the leading ends of the loading beams 7 rest on the floor of the wagon, whereupon the hoses 4*a* are further deflated sufficiently to lift the wheels 5*a* from the ground. This leaves the loading platform 9 supported by the floor of the wagon and the push beams 10*b*.

The push beams are then pulled away from the wagon (to the left in FIGS. 2 and 3) by appropriately sliding the connecting tubular sections 1*c* through the channels of the loading beams 7. When the sections 1*c* have been moved far enough, the outer arc hoses 4*a*′ of the push beams 10*a* are inflated and the inner arc hoses 4*a* are simultaneously fully deflated, which causes the push beams 10*a* to straighten and rise up fully into the loading beam channels. The push beams are then shifted back toward the station wagon until the wheels 5*a* are above the floor of the wagon, whereupon a slight inflation of the inner arc hoses 4*a* and a simultaneous deflation of the outer arc hoses 4*a*′ causes the push beams 10*a* to be curved somewhat so as to lower the wheels 5*a* to the floor of the wagon and to simultaneously raise the leading ends of the loading beams off the wagon floor. This permits the loading platform 9 to be easily advanced into the wagon, with the wheels 5*a* rolling on the wagon floor and wheels 5*b* on the ground. Thereafter, the push beams 10*b* are straightened by deflating the inner arc hoses 4*b* and inflating the outer arc hoses 4*b*′, and the push beams are then pushed forward relative to the loading beams 7 until the wheels 5*b* are above the wagon floor or the lowered rear door of the wagon. The hoses 4*b*′ are then slightly inflated to lower the wheels 5*b* to the wagon floor and slightly raise the trailing ends of the loading beams, whereupon the loading platform can be easily rolled forward until it is completely received in the wagon. The hoses 4*a* and 4*b* are then fully deflated while the hoses 4*a*′ and 4*b*′ are inflated, so as to permit the loading platform to lower itself and come to rest entirely on the loading floor of the wagon.

The unloading of the load and the loading apparatus takes place in reverse order.

The inflation of the outer and inner arc hoses can be performed with a simple commercially available compressor, driven by power supplied from the battery of the station wagon.

It is to be observed that, depending on the height of a tubular section 1, the position of the associated hinge pin 3 and hence of the plate 2 pivotably connected to that hinge pin, is variable within given limits, with the eventually chosen position of the tilting plates 2 together with the shape and spacing of the ends of adjacent tubular sections determining the extent of hinging of two adjoining sections relative to one another. It is possible to choose the position of the tilting plate 2 within the radial dimension of an associated tubular section in such a manner that in the presence of an outer-arc hose and an inner-arc hose, the push beam is bendable in two directions relative to the stretched or extended and straightened position thereof.

Based on the above described effect of the supply or discharge of pressure fluid, e.g. compressed air, to or from the hoses on the behaviour of a push beam according to the present invention, other applications of such push beams are possible in addition to that described herein in connection with a loading and unloading apparatus. For instance, the free end of a push beam will execute a reciprocating movement when the position of one of the ends is fixed during inflation or deflation of a hose of the push beam. Due to this reciprocating movement of a push beam according to the present invention, a to and from movement such as performed by a cylinder-and-piston assembly can be taken over by such a push beam. Thus, a push beam according to the present invention can be used effectively for the pneumatic remote control of a valve in a piping system. The advantage of the use of a push beam in this case is that the friction or binding effect, as encountered in the piston of a piston-and-cylinder assembly, in particular when little use is made thereof, as a result of which such a cylinder-and-piston assembly has to be overdimensioned, is absent in the push beam according to the present invention.

Naturally, modifications can be made on the push beam according to the present invention, as described hereinbefore and as shown in the accompanying drawings, without departing from the scope of the invention.

We claim:

1. A fluid pressure operated push beam, comprising a plurality of similar rigid open-ended tubular sections; a plurality of hinge pins articulating said tubular sections to each other in head-to-tail relationship perpendicular to a longitudinal median plane of the push beam; a number of plates corresponding to the number of hinge pins, each connected to a respective one of the hinge pins for pivotal movement about the axis thereof, the portions of each plate which are situated on either side of the associated hinge pins being disposed in the respective tubular section which is located on the corresponding side of that hinge pin and having a width smaller than the width of said respective tubular section; and inflatable inner arc hose means having a length less than that of the series of tubular sections but larger than the distance between the outermost ones of said hinge pins, said inner arc hose means being disposed within the series of tubular sections in longitudinal direction in the space defined on the same side of said hinge pins and said plates connected thereto, and said inner arc hose means further having closable supply means for directing into said inner arc hose means a pressure fluid operative for inflating said inner arc hose means.

2. A push beam as claimed in claim 1, wherein said tubular sections are tube lengths made from a metal having sufficient strength to resist the forces to which the push beam will be subjected when in service.

3. A push beam as claimed in claim 1, wherein each of said plates has two coaxial hinge pins for pivotally connecting via each such two hinge pins the juncture between two adjacent tubular sections to the associated one of said plates.

4. A push beam as claimed in claim 1, wherein within the series of tubular sections, outer arc hose means are disposed longitudinally within the space defined in said tubular sections on the other side of the hinge pins, said outer arc hose means being provided with closable supply means for directing pressure fluid into said outer arc hose means.

5. A push beam as claimed in claim 1, wherein the tubular sections at the ends of the series of said tubular sections are provided with wheel means for facilitating movement thereof along a surface.

6. A push beam as claimed in claim 4, wherein said closable supply means for the inner and outer arc hose means include a multi-way valve for controlling the fluid pressure feed to said inner and outer arc hose means.

7. Apparatus comprising a lifting platform and suitable for use as an aid in loading and unloading, wherein the lifting platform is operatively associated with one or more push beams (10) as claimed in claim 1.

8. Apparatus as claimed in claim 7, wherein in that the lifting platform comprises two parallel, interconnected loading beams adapted to support a pallet, at least one push beam being placed underneath each said loading beam.

9. Apparatus as claimed in claim 8, wherein the loading beams are constructed as straight inverted channel-shaped members, said members being mounted bottoms up and the push beams being mounted in said channel-shaped members for sliding movement therein.

10. A push beam as claimed in claim 1, wherein said inner arc hose means comprise two separate hoses disposed in longitudinally adjacent regions of the series of tubular sections and each having a separate connection to said closable supply means.

11. A push beam as claimed in claim 1, wherein said inner arc hose means comprise two hose segments disposed in longitudinally adjacent regions of the series of tubular sections and being interconnected with each other to constitute a single hose.

12. A push beam as claimed in claim 4, wherein said outer arc hose means comprise two separate hoses disposed in longitudinally adjacent regions of the series of tubular sections and each having a separate connection to said closable supply means.

13. A push beam as claimed in claim 4, wherein said outer arc hose means comprise two hose segments disposed in longitudinally adjacent regions of the series of tubular sections and being interconnected with each other to constitute a single hose.

* * * * *